United States Patent [19]

Knudson

[11] Patent Number: 4,505,143

[45] **Date of Patent: * Mar. 19, 1985**

[54] WIDE PANEL, PANEL ASSEMBLY, AND PANEL FORMING APPARATUS

[76] Inventor: Gary A. Knudson, 17356 W. 57th Ave., Golden, Colo. 80401

[ * ] Notice: The portion of the term of this patent subsequent to Dec. 21, 1999 has been disclaimed.

[21] Appl. No.: 441,511

[22] PCT Filed: Feb. 19, 1982

[86] PCT No.: PCT/US82/00212

§ 371 Date: Sep. 30, 1982

§ 102(e) Date: Sep. 30, 1982

[87] PCT Pub. No.: WO82/02914

PCT Pub. Date: Sep. 2, 1982

Related U.S. Application Data

[63] Continuation-in-part of Ser. No. 236,832, Feb. 23, 1981, Pat. No. 4,364,253.

[51] Int. Cl.[3] ..... B21D 47/00

[52] U.S. Cl. ..... 72/187; 72/181; 72/234; 72/442

[58] Field of Search ..... 72/181, 182, 179, 176, 72/187, 234, 249, 442, 444; 52/86, 528, 536–538, 588, 630

[56] References Cited

U.S. PATENT DOCUMENTS

| | | | |
|---|---|---|---|
| 2,684,707 | 7/1954 | Getz | 72/187 |
| 2,775,284 | 12/1956 | Hermann | 72/179 |
| 2,986,193 | 5/1961 | Howell | 52/745 |
| 3,006,224 | 10/1961 | Celovsky | 72/234 |
| 3,073,021 | 1/1963 | Goodwill et al. | 72/366 |
| 3,111,788 | 11/1963 | Ouellet | 52/537 |
| 3,333,383 | 8/1967 | Raudebaugh, Jr. | 52/508 |
| 3,462,989 | 8/1969 | Fischer, Jr. | 72/181 |
| 3,466,832 | 9/1969 | March | 52/588 |
| 3,518,859 | 7/1970 | Brinkeborn et al. | 72/442 |
| 3,524,289 | 8/1970 | Yazejian | 52/522 |
| 3,524,292 | 8/1970 | Bottom | 52/522 |
| 3,733,767 | 5/1973 | Craik | 52/529 |
| 3,812,636 | 5/1974 | Albrecht et al. | 52/334 |
| 3,842,647 | 10/1974 | Knudson | 72/177 |
| 3,894,783 | 8/1975 | Matlock et al. | 52/529 |
| 3,902,288 | 9/1975 | Knudson | 52/528 |
| 3,967,430 | 7/1976 | Knudson | 52/745 |
| 3,968,603 | 7/1976 | Merson | 52/574 |
| 4,074,495 | 2/1978 | Bodnar | 52/630 |
| 4,112,722 | 9/1978 | Boucard | 72/181 |
| 4,144,369 | 3/1979 | Wass | 52/450 |
| 4,285,222 | 8/1981 | Jagelid | 72/181 |
| 4,364,253 | 12/1982 | Knudson | 72/181 |

*Primary Examiner*—Daniel C. Crane
*Attorney, Agent, or Firm*—Ancel W. Lewis, Jr.

[57] ABSTRACT

Panel forming apparatus for producing a curved panel from a straight panel disclosed has first and second pairs of wall-indenting dies (281, 282 and 283, 284) spaced from one another to receive therebetween each inclined sidewall portion of a straight panel. A hydraulic motor (M1) is coupled by a power train to rotate said first pair of wall-indenting dies. A hydraulic motor (M2) is coupled by a second power train to rotate the second pair of wall-indenting dies. A third pair of wall-indenting dies (121, 122) is located downstream of the first-mentioned pairs of dies to receive the intermediate wall portion of the panel between each of the third pairs and engage the intermediate wall portion of the panel after it has passed through the first-mentioned pairs of dies. A third hydraulic motor (M3) is coupled by a third power train to rotate the third pair of wall-indenting dies. A tank 301 and pumps (P1, P2) deliver fluid under pressure to the motors. A first control valve (303) controls the fluid to the first and second hydraulic motors and a second control valve (323) controls the fluid to the third hydraulic motor.

6 Claims, 21 Drawing Figures

7
9
8
61
66
64
65
95
93
81
88
103
104
115
114
83
111
109
57
56
64a
65a
67a
68a
71
67
69
72
68
121
124
126
127
128
151
159
160
161
162
163
164
165
155
156
157
158

121
125
126
12
57
128
131
122
129
124
81
82
58
27
26

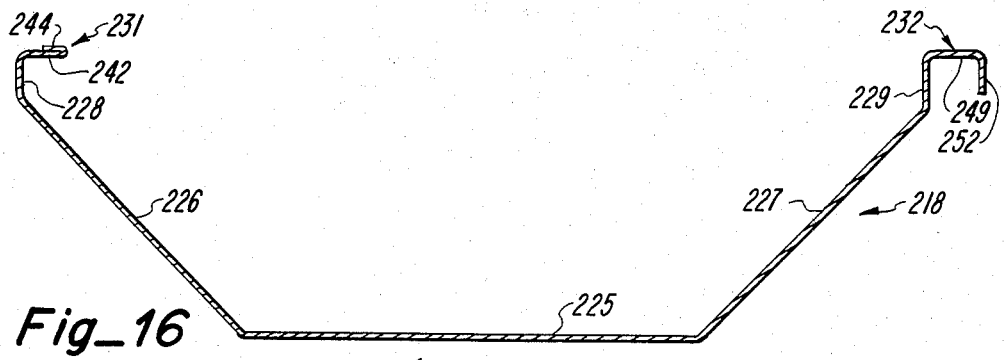
Fig_16
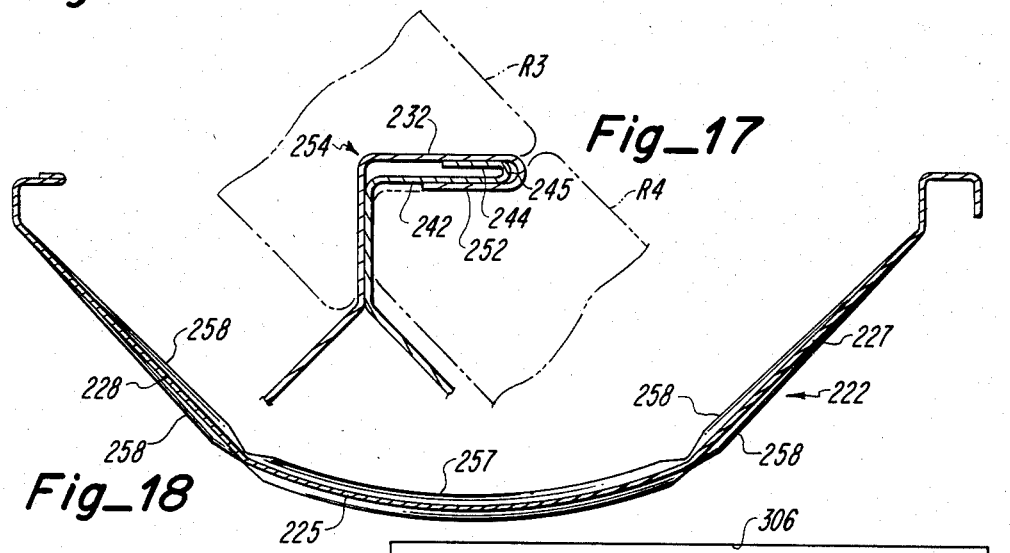
Fig_17
Fig_18
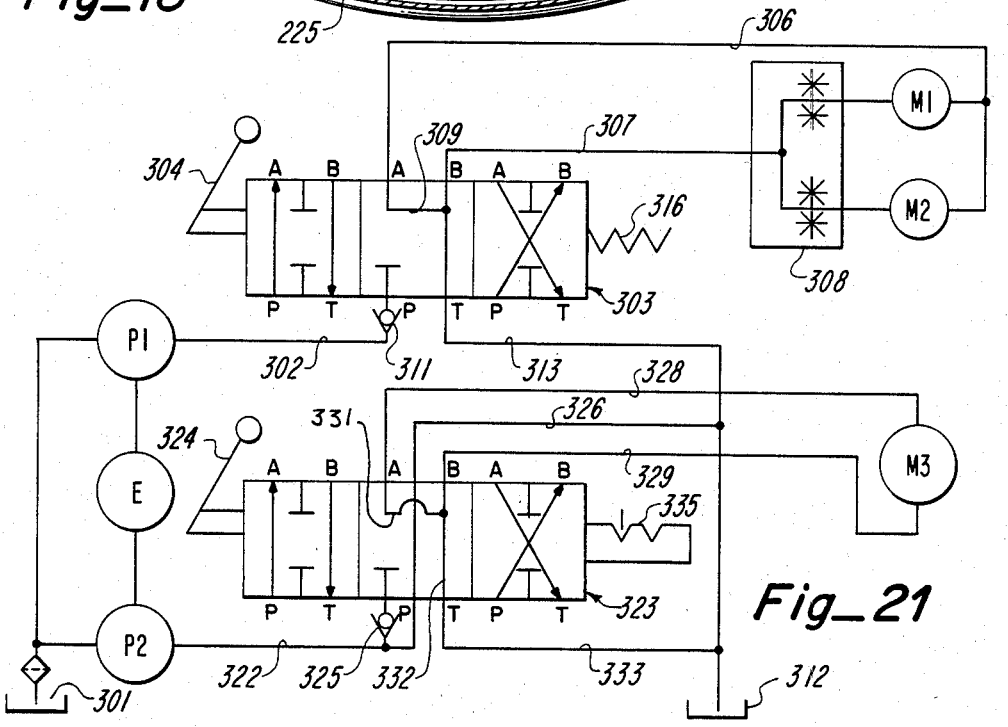
Fig_21

WIDE PANEL, PANEL ASSEMBLY, AND PANEL FORMING APPARATUS

This is a continuation-in-part of U.S. patent application Ser. No. 236,832, filed Feb. 23, 1981, now U.S. Pat. No. 4,364,253.

TECHNICAL FIELD

This invention relates to a novel and improved panel and panel assembly for use in building-type structures and to novel panel-forming apparatus.

BACKGROUND ART

In prior U.S. Pat. Nos. 3,842,647, 3,902,288 and 3,967,430 of the same inventor as the present invention, there are disclosed a shaped panel characterized by parallel sidewall portions that are perpendicular to an intermediate wall portion and a flange that extends directly laterally out from the upper extremities of the sidewall portions so that assembled panels have sidewall portions that fit flush against one another.

DISCLOSURE OF INVENTION

A relatively wide panel and an assembly of the panels are disclosed which are suitable for forming the roof, sidewalls and end walls of a self-supporting building-type structure. The panel has an intermediate wall portion, a pair of opposed, upwardly diverging, inclined sidewall portions, and a pair of parallel upper side sections that abut against one another when two of the panels are joined side by side. One form of the panel has the upper side section disposed at an incline and has a pair of wing portions of substantial lateral extent in relation to the intermediate wall portion between the upper side section and the inclined sidewall portions, together with male and female edge fastening means extending beyond the upper side section and above the wing portions. Each wing portion, upper side section, and associated edge fastening means has a dimension related to the dimension of the intermediate wall portion to provide a balanced structure that has substantially the same resistance to both compression and tension loading forces when two of the panels are connected side by side. The edge fastening means of a pair of adjacent panels are located above and substantially centered between the edges of adjacent wing portions which are connected along a continuous seam structure. Another form of the panel does not have the wing portions and has upper side sections that extend vertically up from the lateral extremities of the inclined sidewall portions. Forming apparatus for changing a straight panel to a curved panel is arranged for forming transverse indentations in the intermediate wall portion and each of the sidewall portions. The forming apparatus includes separate, alternately operable pairs of indenting dies, each with a hydraulic drive using a hydraulic control system with one idling while the other is being driven.

BRIEF DESCRIPTION OF DRAWINGS

The details of this invention will be described in connection with the accompanying drawings, in which:

FIG. 16 is a transverse cross-sectional view of another form of straight panel embodying features of the present invention;

FIG. 17 is an enlarged transverse cross-sectional view of the continuous seam structure joining two of the panels shown in FIG. 16;

FIG. 18 is a transverse cross-sectional view of the curved panel made from the straight panel shown in FIG. 16;

FIG. 21 is a schematic diagram of the drive and control for the hydraulic drive motors shown in FIGS. 19 and 20.

DETAILED DESCRIPTION

Figure 1:
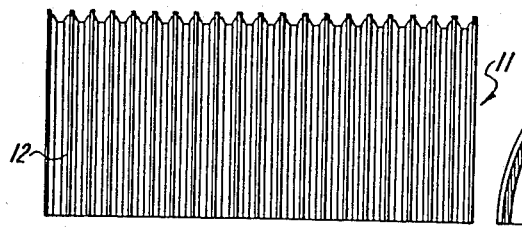
FIG. 1 is a side elevation view of a self-supporting building having an assembly of interconnected panels embodying features of the present invention.
Figure 2:
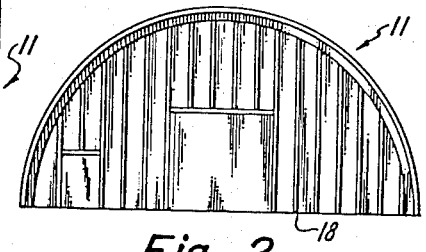
FIG. 2 is an end elevation view of the building shown in FIG. 1.

Referring now to the drawings, there is shown in FIGS. 1 and 2 a self-supported or free-standing building 11 comprised of an assembly of curved panels 12 forming both a roof and opposed sidewalls of the building, and an assembly of straight panels 18 forming the end walls of the building.

The straight panel 18 preferably is produced by a roll-forming machine from a strip of a flat sheet of stock material of sheet metal or the like and may utilize the method and machine disclosed in U.S. Pat. No. 3,529,461. The panel 18 shown has a lower intermediate wall portion 25, a pair of opposed, upwardly diverging, inclined sidewall portions 26 and 27, and a pair of upper, laterally extending wing portions 28 and 29. Wing portion 28 has a raised male edge fastening means 31 and wing portion 29 has a raised female edge fastening means 32.

The sidewall portions 26 and 27 extend laterally out from the lateral extremities or opposite side edges of the intermediate wall portion 25 and, more specifically, are turned upwardly from the plane of the intermediate wall portion through a selected acute angle. This angle is greater than 45°, and preferably between about 55° and 60°, so as to be closer to a plane perpendicular to the intermediate wall portion, or more upright than horizontal, to increase the overall width of the panel as compared to panels that have sidewall portions perpendicular to the intermediate wall portion.

Figure 3:
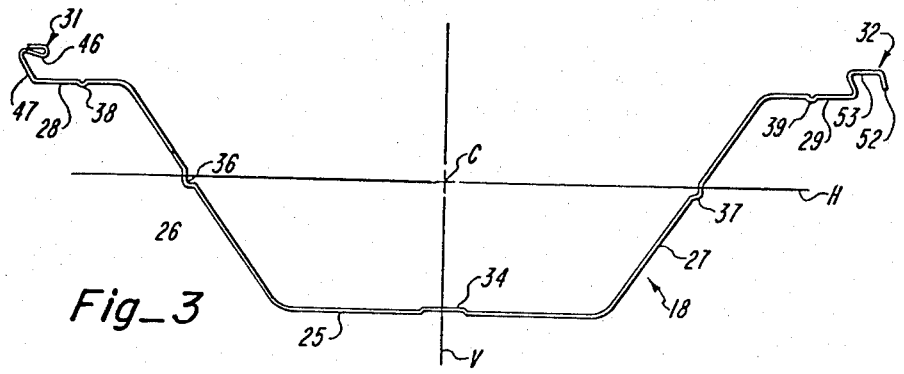
FIG. 3 is a transverse cross-sectional view of a straight panel embodying features of the present invention.

For reference purposes, in FIG. 3 a vertical median line for the panel is designated V, a horizontal median line is designated H, and these lines intersect at the geometric center for the panel which is designated C. In describing the specific embodiment the terms "upward" and "downward" refer to the illustrated embodiment in its normal position of use and the terms "inward" and "outward" refer to directions toward and away from its geometric center.

The intermediate wall portion shown is substantially flat and has a longitudinally extending groove 34 centered on the vertical median line V of the panel. Sidewall portion 26 has a longitudinally extending groove 36 and sidewall portion 27 has a longitudinally extending groove 37, grooves 36 and 37 being located approximately at the horizontal median line H for the panel. Wing portion 28 has a longitudinal groove 38 and wing portion 29 has a longitudinal groove 39, each located at approximately the middle of the associated wing portion. These grooves are optional but in practice were found to provide additional panel strength, greater rigidity and greater durability in the panel.

Figure 5:
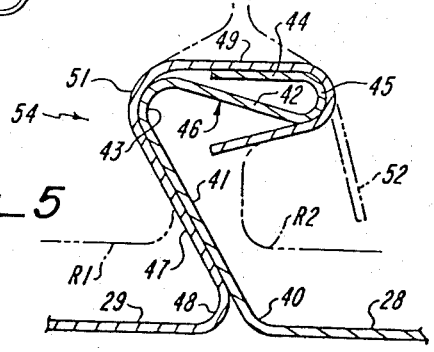
FIG. 5 is an enlarged transverse cross-sectional view of the continuous seam structure shown in FIG. 4.

Referring now to FIG. 5, the panel 18 shown has an outwardly inclined side section 41 extending latout from a lateral extremity or side edge of wing portion 28 and, more specifically, turned upwardly from the plane of wing portion 28 at a bend 40 through an acute angle between about 55° and 60°, together with a lateral flange portion 46. The side section 41 has a length related to the thickness of the seaming rollers R1 and R2, described hereinafter, that permits a portion of the roller R2 to fit between the wing portion 28 and the lateral flange portion 46.

The raised male edge fastening means 31 has an inturned lateral flange section 42 which extends laterally in and at a slight downward incline toward the center of the panel, around through a bend 43 of about 125° from the plane of section 41, along a terminal outturned lateral flange section 44 looped back at a bend 45 of about 180°, and over section 42 which is parallel to wing portion 28 to provide the male lateral flange portion 46 of double thickness, that is substantially parallel to and substantially spaced above the wing portion 28, with a smooth surface along the inside bend 45. This incline in side section 41 locates the male lateral flange portion 46 in a substantially centered position in relation to the lateral extremity of the associated wing portion 28. The inclined side section 41 has enough height to permit the seaming roller R2 to fit between the lateral flange and the associated wing portion.

The panel 18 further has an inwardly inclined side section 47 extending laterally in from a lateral extremity of wing portion 29 toward the center of the panel. Inclined side section 47 is turned upwardly from the plane of wing portion 29 through a bend 48 at an angle between about 120° and 125° so that inclined side sections 41 and 47 of adjacent panels are parallel to one another and section 41 overlaps section 47 of the adjacent panel. Inclined side section 47 therefore also has an incline and length selected in relation to the thickness of the seaming roller R1 to permit that roller to engage and track on section 47.

The raised female edge fastening means 32 shown has a lateral flange section 49 which extends laterally out from the upper end of inclined side section 47 through a bend 51 of about 120°–125° to be back parallel to wing portion 29, and a terminal flange section 52 is turned through a bend of about 60°–80° from the plane of section 49 to provide a female lateral flange portion in the form of an open inverted channel structure with a receiving opening wider than the width of the male edge fastening portion 46 of the adjacent panel which is directly inserted thereinto. A feature of the edge fastening means shown is that it is not necessary to rotate the panel about its axis to insert the male lateral flange portion 46 into the female lateral flange portion 53.

The panel 18 above described has certain dimensional relationships which provide substantially the same structural strength above and below the horizontal median line H for the panel and because of these relationships the panel is herein referred to as a "balanced" or "substantially balanced" panel. In particular, the dimension of the male edge fastening means 31 is substantially the same as that of the female edge fastening means 32, the dimension of the wing portions 28 and 29 is substantially the same, the dimension of the side sections 41 and 47 is substantially the same, and the dimension of each edge fastening means, side section and associated wing portion is substantially the same as one-half of the dimension of the intermediate wall portion 25 so as to provide substantially the same strength above and below the horizontal median line H for the panel.

The dimension of each wing portion is substantial in relation to the dimension of the intermediate wall portion 25. More specifically, the dimension of each wing portion is greater than one-half the half-width or greater than one-fourth the dimension of the intermediate wall portion 25.

These size or dimension relationships are significant when the panel is under load and the portion of the panel above the horizontal median line is under compression and the portion of the panel below the horizontal median line is under tension. Since the material dimensions of the panel above and below the horizontal median line are substantially the same, there is substantially the same resistance to compression and tension loading forces and hence the panel may be said to be a balanced structure. Moreover, the dimension of the male and female edge fastening means is the same and their location with respect to the vertical median line is substantially the same to provide a symmetrical structure with respect to vertical median line V.

The panel 18 shown typically is shaped from a roller strip of sheet metal of about 22 gauge, preferably prefinished or galvanized steel. This strip is formed into the shaped panel shown by being passed through a continuously operable roll-forming machine of the general type disclosed in U.S. Pat. No. 3,529,461.

By way of illustration and not by way of limitation, a typical wide panel as above described has the following dimensions:

| | |
|---|---|
| Width of sheet stock | 91.44 cm |
| Intermediate wall portion | 20.32 cm |
| Wing portion | 7.62 cm |
| Depth of corrugations | 1.27 to 0.3175 cm |
| Width of panel | 60.96 cm |
| Depth of panel including | 20.32 cm |

-continued

| |
|---|
| seaming edges |

In assembling two of the above described panels together, the male lateral flange portion 46 of one panel is inserted into the female lateral flange portion 53 of the other panel, which can be done without rotating the panel about its axis. A seaming device is preferably used to turn the terminal flange section 52 from the open position shown in FIG. 3 to a closed position under a portion of the underside of the lateral flange section 42 of the adjacent panel to form a continuous seam structure 54. The seam structure 54 of the assembly is seen to be centered approximately at the side edges or lateral extremities of the abutting side wing portions of adjacent panels.

The terminal flange section 52 is shown to be folded back through an angle of between about 90° and 120° to a position underlying the male flange section 42 and may extend down at an angle of about 15° to the horizontal or folded back to be substantially horizontal, depending on how tight a seam structure is required.

The outline of two seaming rollers R1 and R2 suitable for this purpose is indicated in dashed lines, as above discussed. The general operation of a seamer that travels along a panel flange and forms a seam is disclosed in U.S. Pat. No. 3,875,642, and a specific seamer suitable for forming the seam of these panels is disclosed in my copending application entitled "Seaming Apparatus with Laterally Separable Rollers."

Figure 4:
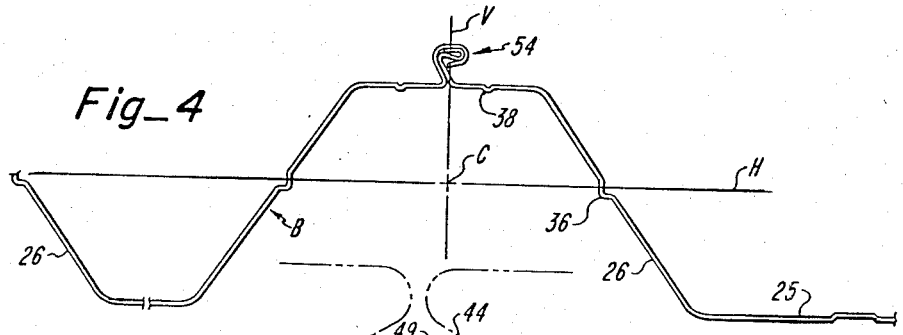
FIG. 4 is a transverse cross-sectional view of an assembly of two of the panels of FIG. 3 connected side by side at continuous seam structure.

When two of the panels are connected side by side as shown in FIGS. 4 and 5 with the male and female fastening flanges connected, there are provided two substantially symmetrical half-section shapes alternately above and below the horizontal median line H for the assembly. The vertical median line that passes through the center of the panel assembly shown in FIG. 5 is again designated V. Under load the portion of the assembly above the horizontal median line H is under compression and the portion of the assembly below the horizontal median line H is under tension.

Referring now to FIGS. 6–15, there are shown panel forming apparatus and the resulting curved panel 12 produced by the panel forming apparatus, the curved panel 12 having longitudinally spaced transverse indentations 57 in the intermediate wall portion 25 and longitudinally spaced, tapered, transverse indentations 58 in each of the inclined sidewall portions 26 and 27. The tapered indentations 58 are wider at the bottom and reach an apex at the top. A preferred taper for indentations 58 is about one degree on each side of the plane of the panel or a total taper of two degrees, as seen in the sectional view in FIG. 12.

The panel forming apparatus shown includes a skeletal, rectangular, support frame having laterally spaced upper side members 61 and laterally spaced lower side members 62, together with upright connecting members 63 connected on both sides at the ends and at spaced intervals along the side members to provide an open box-shaped frame configuration.

Beginning at the infeed end, there are provided two guide assemblies at spaced positions along a preselected straight line course of travel for the panel. A first guide assembly includes an upper roller set comprising an upper guide roller 64 and a lower guide roller 65 mounted on an upper support plate 66, together with a lower roller set comprising an upper guide roller 67 and two lower guide rollers 68 and 69 spaced along the apparatus and mounted on a movable lower support member 71. The upper roller 64 has a V-shaped peripheral groove and the lower roller 65 has a complementary V-shaped periphery. These rollers are tilted in at an angle of about 20° to the vertical and they engage the inturned inclined side section and an outer portion of the associated wing portion of one side of the flange on the panel.

The upper roller 67 is arranged to rotate about a horizontal axis and has a smooth peripheral surface. Each of the lower rollers 68 and 69 has an asymmetrical groove in its periphery on which the raised lateral flange portion of the panel, turned on its side, will rest. The upper roller 67 engages the inside bend of the fastening flange structure and the inclined section of the panel rides in the asymmetrical groove. The support member 71 is adjustable up and down by a threaded bolt-nut arrangement 72 for a prealinement adjustment for the panel.

The second guide assembly, located downstream of the first, includes a set of one upper and two lower guide rollers **64*a* and 65*a* similar to the upper rollers 64 and 65 above described and in a straight line therewith and a set of one upper guide roller 67*a* and one lower guide roller 68*a* similar to the rollers 67 and 68** in the first guide roller arrangement above described and in alinement therewith. This guide arrangement supports and guides the incoming panel and directs it into the pairs of wall-indenting dies hereinafter described. These guide assemblies minimize abrasion of the panel and provide for both a vertical and a lateral position adjustment.

The sidewall indenting assembly is mounted inside the support frame and includes a first pair of wall-indenting dies 81 and 82 that form tapered indentations 58 in sidewall portion 27 of the panel and a second pair of wall-indenting dies 83 and 84 similar to pair 81 and 82 that form tapered indentations 58 in inclined sidewall portion 26 of the panel. The first pair of wall-indenting dies is disposed at an incline so as to support the panel on its side with the intermediate wall portion 25 in a vertically disposed position.

Each of the wall-indenting dies 81, 82, 83 and 84 is tapered or in the general shape of a truncated cone and, more specifically, the outer die of each set is wider at the top and narrower at the bottom with respect to the top and bottom of the sidewall portion of the panel while the inner die is the reverse, narrower at the top and wider at the bottom with respect to the top and bottom of the sidewall portion of the panel to provide the tapered indentations 58 in the sidewall portions of the panel as above described.

Figures 8, 9, 10, 14:
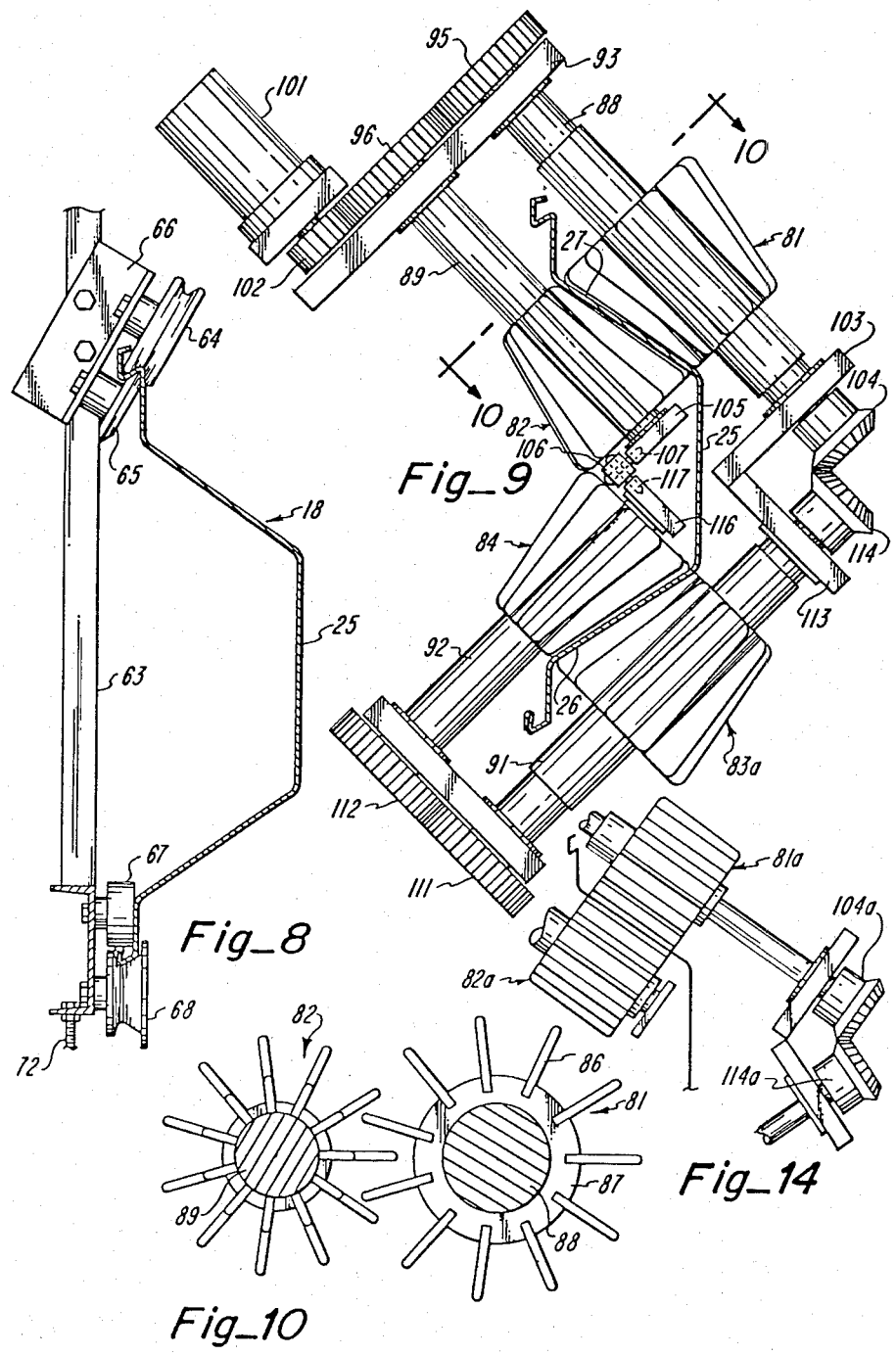
FIG. 8 is an end elevation view of the entry guide portion of the apparatus shown in FIG. 6.
FIG. 9 is an end elevation view of the sidewall indenting rollers shown in FIG. 6.
FIG. 10 is a sectional view taken along lines 10—10 of FIG. 9.
FIG. 14 is an end elevation view of an alternate set of wall indenting rollers.

Each die is of a similar construction and, with reference to die 81, this die, as shown in FIG. 10, has a plurality of circumferentially spaced and radially extending die blades 86 mounted in a hub 87 which in turn is carried by a support shaft 88. In turn, die 82 has a support shaft 89, die 83 has a support shaft 91, and die 84 has a support shaft 92.

The upper ends of the shafts 88 and 89 are journaled in suitable associated bearings in a support plate 93 and gears 95 and 96 are mounted on the upper ends of shafts 88 and 89, respectively, and mesh with one another. Drive motor 101 for the wall-indenting dies 81, 82, 83 and 84 has a gear 102 on its output shaft that in turn meshes with gear 96. When the motor 101 rotates, gears 95 and 96 and associated dies 81 and 82 are driven at the same speed in opposite directions. When the motor 101 is not rotated, the dies 81 and 82 rotate freely in an idle mode of operation.

The opposite end of shaft 88 is journaled in a bearing in a support plate 103 and carries a right-angle bevel gear 104 on its lower end. The lower end of the shaft 89 is journaled in a bearing in a support plate 105 which in turn is carried by an adjustable support in the form of a stationary block 106 having a thread screw 107. This arrangement enables the inner die 82 to be adjustably moved toward or away from outer die 81 to adjust the depth of the corrugations or indentations in the sidewall portions of the panel.

The second pair of wall-indenting dies 83 and 84 is similar in construction to the upper pair above described and is arranged at right angles thereto. The outer die 83 is wider at that portion that engages the upper portion of the inclined sidewall portion of the panel and the inner die 84 is narrower at the end adjacent to the wider end of die 83.

The support shafts 91 and 92 have adjacent ends journaled in bearings in a support plate 109, together with meshing gears 111 and 112 on their adjacent ends. The opposite end of shaft 91 is journaled in bearings in a support plate 113 with a right-angle bevel gear 114 on one end that meshes with bevel gear 104 above described. Shaft 92 has the end opposite gear 112 journaled in a bearing in a support plate 116 which in turn is carried by stationary block 106 and has an adjustment screw 117 to enable die 84 to be moved toward and away from die 83 to adjust the depth of the indentations in the sidewall portions of the panel.

In summary, the transmission of power from motor 101 is first through gears 102, 96 and 95 and then through the bevel gear 103 to bevel gear 114 and via shaft 91 to gears 111 and 112 and finally to shaft 92, so that when the motor 101 is actuated all of the wall-indenting dies 81, 82, 83 and 84 are rotated at synchronized speeds.

An alternative form of dies and power train for making the indentations in the sidewall portions shown in FIG. 14 has dies 81*a* and 81*b* with less taper and bevel gears 104*a* and 114*a* less than right-angle gears.

The wall-indenting die assembly for the intermediate wall portion includes a left side indenting die 121 and a right side indenting die 122 as viewed from the feed end. Each of these dies is similar in construction. Die 121 has a plurality of circumferentially spaced, at equal angles, and radially extending die blades 124 mounted on a hub 125 on a support shaft 126 which in turn is journaled in a top bearing 127 and a bottom bearing 128, making die 121 suitable for free rotation about its axis. Right side die 122 has die blades 128 mounted on a hub 129 on a shaft 131 that rotates freely in a top bearing 132 and a bottom bearing 133. A preferred orientation is to have the die shafts disposed upright.

The die blades 124 of left side die 121 have a generally cylindrical or roller-like profile with rounded corners and the opposite die blades 128 of die 122 have raised portions 135 at the corners that serve to bring the indentation around the corner of the panel and establish a corner radius in each indentation in the panel.

The left side die 121 has its top bearing 127 mounted on a slide plate 141 carried by a slotted stationary base plate 143 on a top cross member 144. The side edges of plate 141 are beveled to slide in and be retained by a pair of complementary beveled slot surfaces in base plate 143.

The slide plate 141 is moved by the use of an internally threaded block 145 affixed to slide plate 141 and a screw 146 that threads therein. The screw is threaded via a gear box 147 and handle 148. A similar drive is provided for moving the bottom bearing 128 that is operated by moving a handle 149. The lower slotted stationary base plate 143 for slide plate 141 is mounted on a lower cross member 151. With this drive arrangement, upon the movement of handles 148 and 149 the die 121 is moved toward and away from the right side die 122 to change the depth of the indentations in the intermediate wall of the panel and thereby the degree of arch in the panel. It will be observed that each of the top and bottom ends of the shaft 126 for the left side die 121 is adjustably movable independently of the other.

Figure 6:
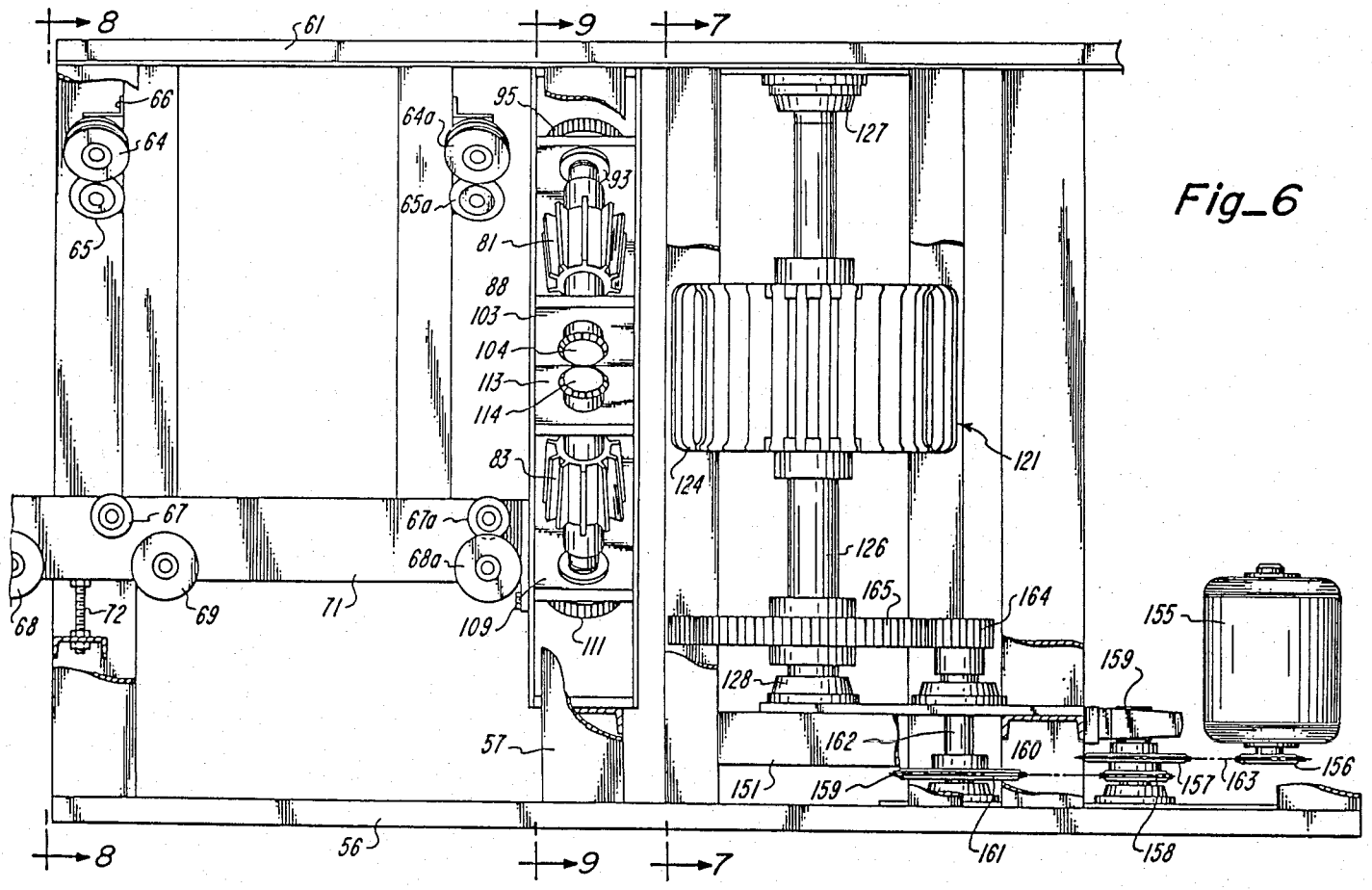
FIG. 6 is a side elevation view of forming apparatus embodying features of the present invention with portions broken away to show interior parts.
Figure 7:
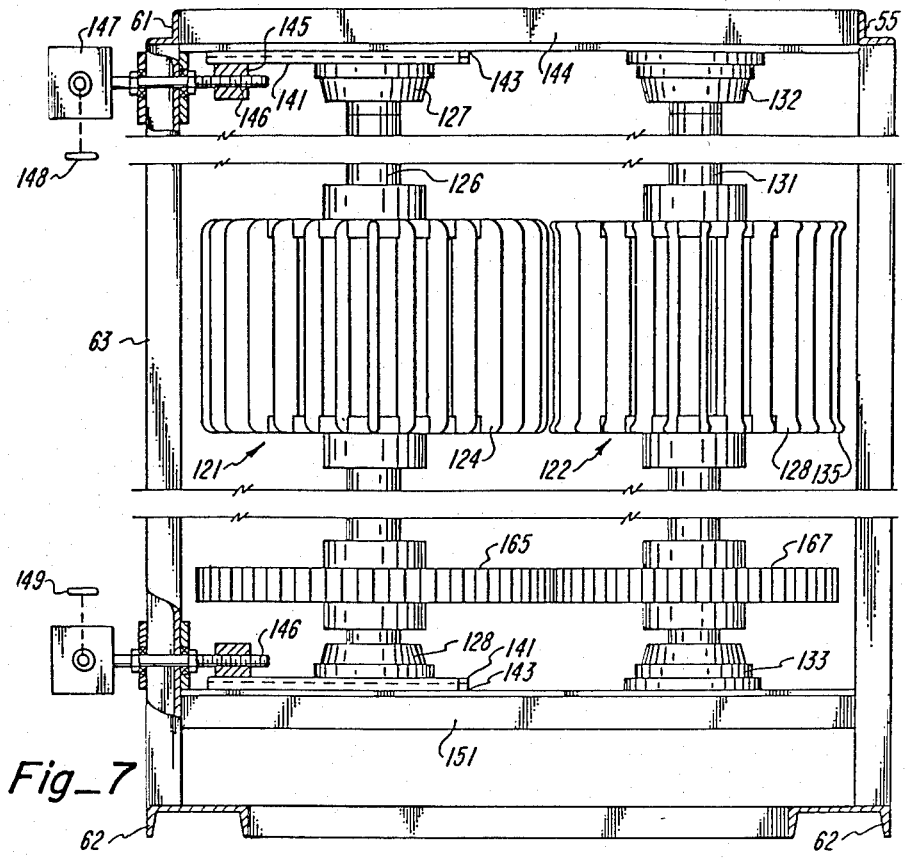
FIG. 7 is an end elevation view of the intermediate panel indenting rollers.

The hydraulic motor 155 for driving the wall-indenting dies 121 and 122 is shown in FIG. 6 as supported by the frame. The power transmission train includes a sprocket 156 on the output shaft of the motor 155, a first pair of intermediate sprockets 157 and 158 on a vertical shaft 159, and a second intermediate sprocket 161 on a second vertical shaft 162 with a chain 163 around sprockets 156 and 157 and a chain 160 around sprockets 158 and 161. Shaft 162 has a gear 164 that meshes with a gear 165 on shaft 126 of die 121. Gear 165 meshes with gear 167 on shaft 131 of die 122 (FIG. 7). With this drive arrangement dies 121 and 122 are driven in opposite directions at synchronized speeds when motor 155 is actuated.

Figure 15:
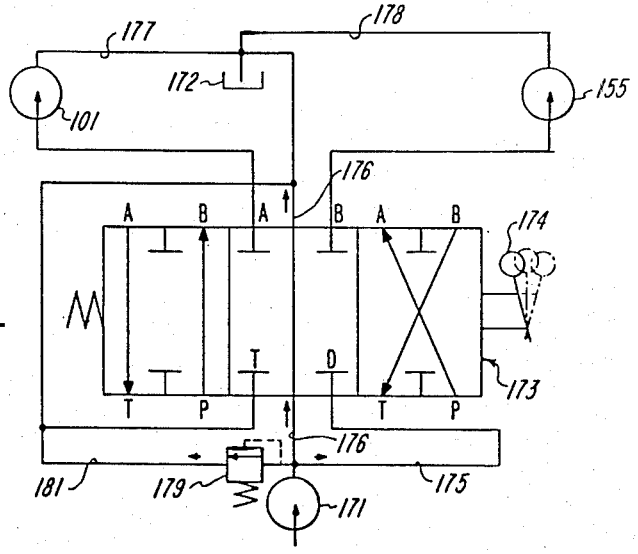
FIG. 15 is a schematic diagram of the drive and control for the drive motors.

The hydraulic drive system for powering hydraulic motors 101 and 155 is shown in FIG. 15. The system includes a conventional hydraulic pump 171, a hydraulic tank 172, and a three-position, open center, detented spool control valve 173 having a control lever 174. An open center core hydraulic line 176 is connected from the output of the pump to the tank via the center core of the valve 173 when the lever 174 is set in the center or middle position and, while in this setting, hydraulic fluid is pumped from the pump 171 directly into the tank via line 176.

When the lever is moved toward the operator the valving arrangement shown to the right side in valve 173 is positioned in the center of the valve so that there is a P-A connection in the valve 173 and fluid is pumped from the pump 171 via a power core line 175 to the wall-indenting motor 101 and back into the tank 172 by return line 177. Additionally, there is a B-T connection in the valve that enables fluid to flow through the wall-indenting motor 155 and back into the tank via a return line 178 in an idle mode of operation for motor 155. "P" is an abbreviation for power and "T" an abbreviation for tank. The designations "A" and "B" are output ports of the valve 173.

When the control lever 174 is pushed away from the operator to the power mode for motor 155, the valving connections shown on the left side of valve 173 are moved to the center of the valve and a P-B connection has the pump 171 pumping via line 175 into the motor 155, and an A-T connection enables fluid to pass through the motor 101 and line 177 in an idle mode of operation for motor 101.

An adjustable pressure relief valve 179 is shown connected between the output of the pump 171 and the tank in a bypass line 181 which will pass fluid directly to the tank 172 in the event the line pressure exceeds a selected pressure such as 1500 psi, as a safety feature.

The direction of rotation of either of the drive motors may be reversed by means of an electric solenoid valve associated with the control valve to reverse fluid flow when in the drive mode for that motor. In a preferred mode the solenoid will be reversed by means of an electric limit switch located at the end of a run-out table for the panel triggered by engagement by the panel.

In a full sequence of operation with a straight panel 12 supported by the guide assembly, when the lever 174 is pulled forward toward the operator the dies 81, 82, 83 and 84 are powered and dies 121 and 122 are in the idle mode. The former grip the panel and push it between dies 121 and 122. The lever 174 is then pushed to the rear and dies 121 and 122 are powered and grip the panel and dies 81, 82, 83 and 84 are in the idle mode and a succession of equally spaced corrugations or indentations is continuously performed in walls of the panel as it is passed therethrough. This arrangement eliminates the need for a cam clutch, etc., and uses an independent direct drive system for the dies associated with the intermediate wall portion and the dies associated with the sidewall portions. The hydraulics affords a relatively simple drive and control system.

Another form of straight panel 218 shown in FIG. 16 has a lower intermediate wall portion 225, a pair of opposed, upwardly diverging, inclined sidewall portions 226 and 227, and a pair of vertical upper side sections 228 and 229 arranged parallel to one another. Side section 228 supports a raised male edge fastening means or inturned male lateral flange portion 231 and side section 229 supports a raised female edge fastening means or outturned female flange portion 232.

The inclined sidewall portions 226 and 227 extend laterally out from the lateral extremities of the intermediate wall portion and, more specifically, are turned up from the plane of the intermediate wall portion 225 through an angle of about 45°.

The male edge fastening means 231 shown includes a lateral section 242 extending in from the upper extremity of vertical upper sidewall portion 228 at a right angle thereto and the end section 244 is looped back through a bend 245 of about 180° to provide the male lateral flange portion 231 which is of double thickness and is substantially parallel to the intermediate wall portion 225.

The raised female edge fastening means 232 includes a lateral section 249 extending laterally out from the upper extremity of side section 229. Lateral section 249 turns through a bend of 90° to section 229. A downturned terminal flange section 252 is turned through a bend of 90° to lateral section 249 to form with section 229 an open inverted channel structure with a receiving opening wider than the lateral extent or width of the male lateral flange portion 231 of the adjacent panel which is directly inserted thereinto in assembling two of the panels together side by side.

The panel 218 above described is also a "substantially balanced" panel and in particular the dimensions of flange portions 231 and 232 are substantially the same, the dimensions of side sections 228 and 229 are substantially the same, and the combined dimensions of portions 231 and 228 or portions 229 and 232 are substantially one-half the dimension of the intermediate wall portion 225, so as to provide substantially the same strength above and below a horizontal median line for the panel.

In assembling together two of the above described panels 218, the male flange portion 231 of one is inserted into the female flange portion 232 of the adjacent panel. A seaming device is used to turn the terminal flange section 252 to a closed position under a portion of the underside of the flange portion 242 of the adjacent panel to form a continuous seam structure 254, as shown in FIG. 17. This seam structure is offset to the inside of the panel assembly and, more specifically, is offset to the inside of abutting vertical upper side sections 228 and 229 of adjacent panels.

The outline of two seaming rollers R3 and R4 suitable for seaming the panels together is indicated in dashed lines in FIG. 17. The general operation of a seamer that travels along the panel flanges and forms the seam is disclosed in my above mentioned copending application.

When the two panels are connected side by side, there are two symmetrical half-section shapes to the left and right of a vertical median line for the assembly.

A curved panel 222, shown in FIG. 18, produced by the panel forming apparatus described hereinafter has longitudinally spaced transverse indentations 257 in downwardly bowed intermediate wall portion 225 and longitudinally spaced, tapered, transverse indentations 258 in each of the inclined sidewall portions 226 and 227 similar to those in the curved panel shown in FIG. 13. The taper for the indentations is one degree on each side of the plane of the panel, or a total taper of two degree, as is seen in FIG. 18.

By way of illustration and not by way of limitation, a typical panel as above described has the following dimensions:

| | |
|---|---|
| Width of flat sheet | 60.96 cm |
| Intermediate wall portion of straight panel 225 | 20.32 cm |
| Side section 229 | 2.54 cm |
| Side section 228 | 2.38 cm |
| Lateral section 242 | 2.2225 cm |
| Lateral section 249 | 2.69875 cm |
| Depth of corrugations 258 | 1.27 to 0.3175 cm |
| Width of straight panel | 40.64 cm |
| Depth of straight panel | 12.7 cm |
| Width of curved panel | 40.64 cm |
| Depth of curved panel | 15.24 cm |

The same guide assemblies, intermediate wall portion indenting dies, and associated support structure as above described are used to form the curved panel 222.

Figures 19, 20:
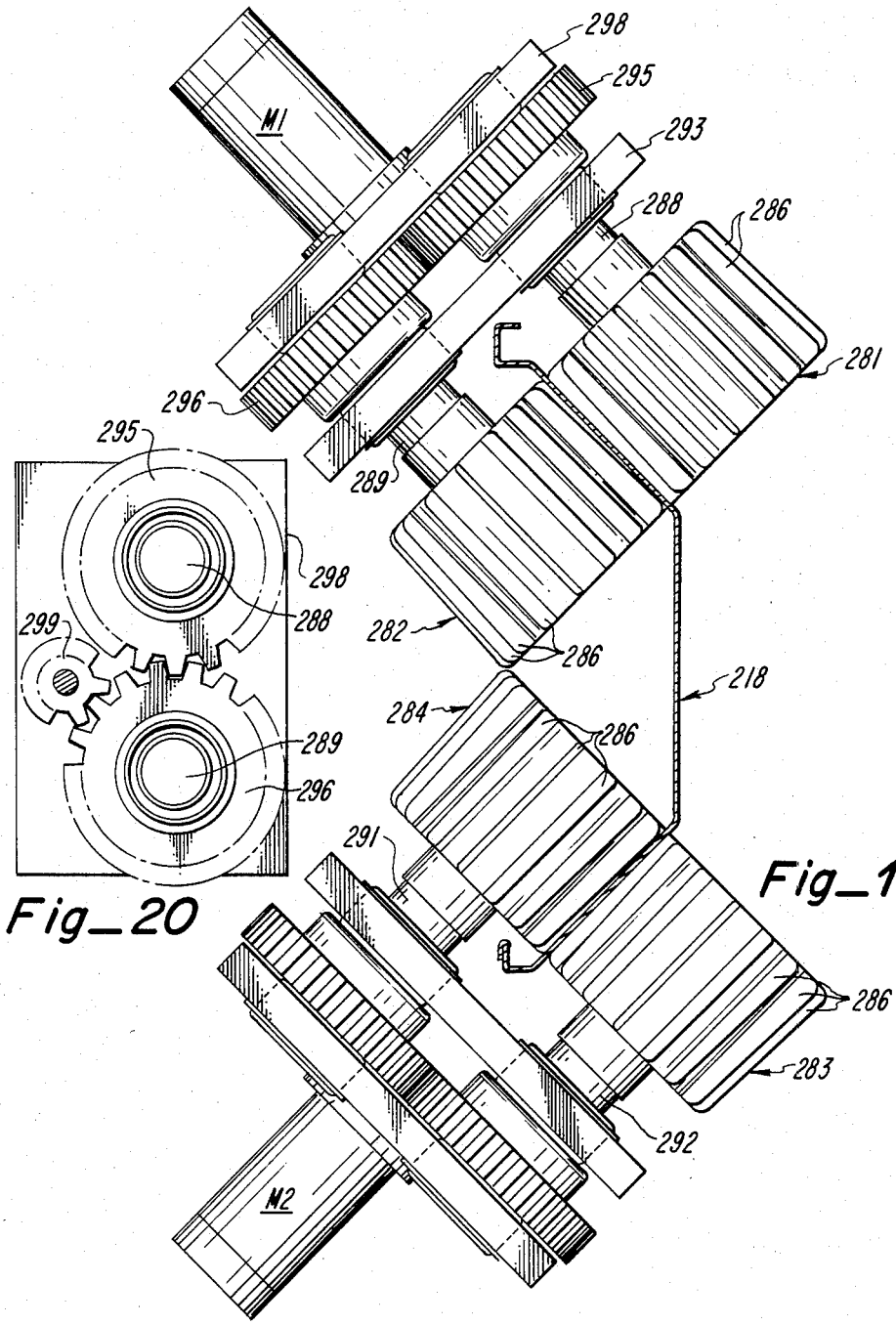
FIG. 19 is an end elevation view of another form of wall indenting dies for forming the curved panel shown in FIG. 18.
FIG. 20 is a plan view of the drive system for one of the wall indenting dies with the motor removed.

A modified form of sidewall indenting assembly is shown in FIGS. 19 and 20. The sidewall indenting assembly includes a first set or pair of wall-indenting dies 281 and 282 that form the tapered indentations 258 above described in the inclined sidewall portion of the panel and a second set or pair of wall-indenting dies 283 and 284 similar to pair 281 and 282. These two pairs of dies are disposed along axes that are at right angles to one another.

Each of the dies is tapered about one degree. The outer dies 281 and 283 of each pair are wider at the top and narrower at the bottom, while the inner dies 282 and 284 of each pair are wider at the bottom and narrower at the top. Each die has a plurality of circumferentially spaced, radially extending die blades 286 of a similar shape and construction. The blades of dies 281 and 282 are mounted on hubs supported on parallel spaced shafts 288 and 289, respectively. The blades of dies 283 and 284 are mounted on hubs supported on parallel spaced shafts 291 and 292, respectively.

The upper end portions of the pair of shafts 288 and 289 are journaled in associated bearings carried in a stationary top support plate 298. Gears 295 and 296 are mounted on shafts 288 and 289, respectively, and mesh with one another. Gears 295 and 296 are located below top support plate 298. Intermediate portions of the shafts 288 and 289 are journaled in bearings carried in a stationary intermediate support plate 293 located below gears 295 and 296. Support plates 293 and 298 are carried by the stationary support frame above described.

The hydraulic drive motor M1 for rotating dies 281 and 282 is mounted on the top support plate 298 and has a gear 299 on its output shaft that meshes with gear 296 so that, when motor M1 rotates, the dies 281 and 282 rotate in opposite directions. When motor M1 is not being powered, the dies 281 and 282 rotate freely in an idle mode of operation.

The support and drive for dies 283 and 284 and their associated shafts are identical to those for dies 281 and 282 above described. The pairs of shafts for dies 283 and 284 are disposed at right angles to the shafts supporting dies 281 and 282. The hydraulic drive motor for rotating dies 281 and 282 is designated M2.

Figures 11, 12, 13:
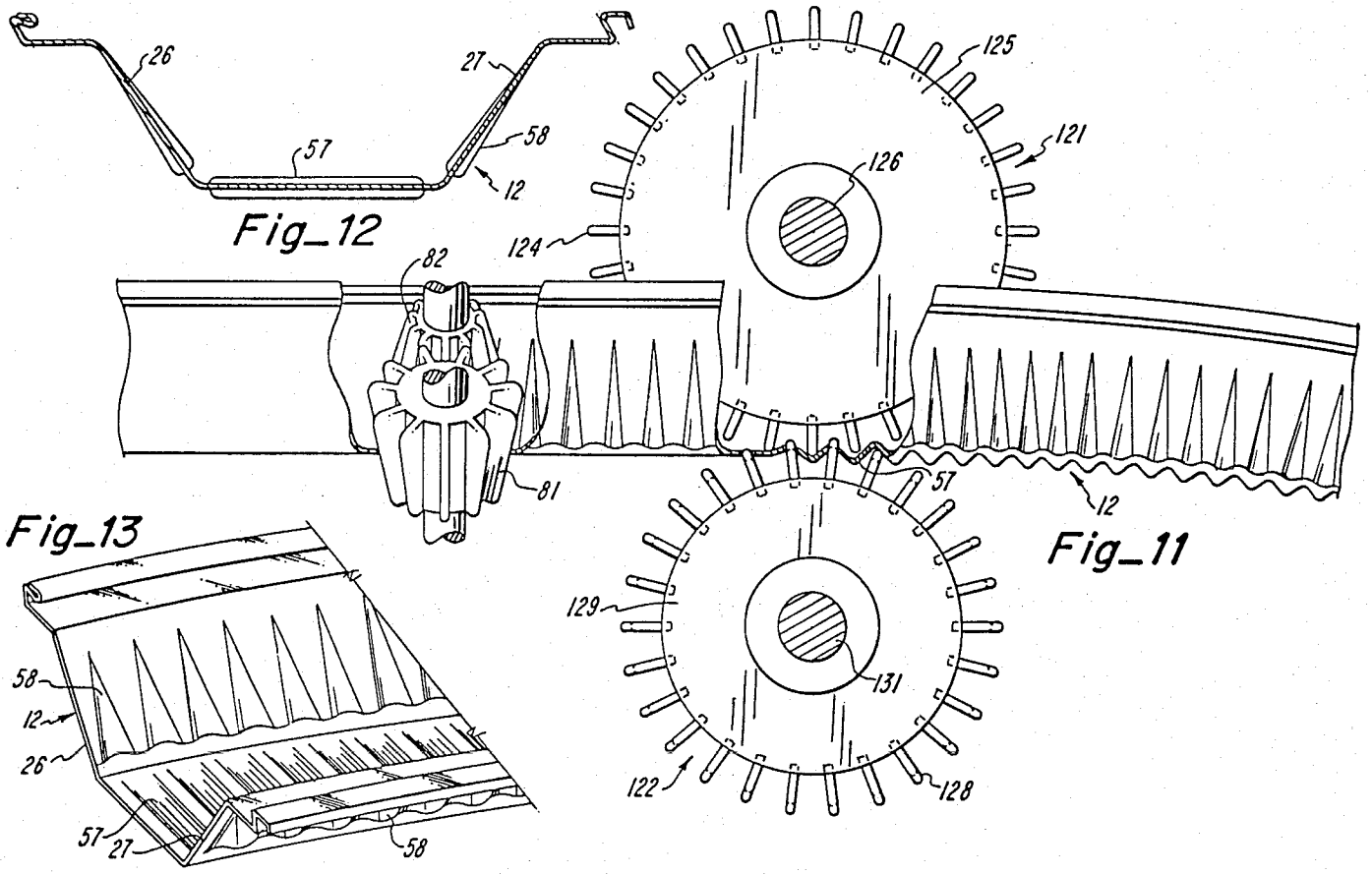
FIG. 11 is a top plan view of the wall-indenting rollers.
FIG. 12 is a sectional view of the curved panel.
FIG. 13 is a perspective view of a segment of a curved panel.

It is understood that the above described die arrangement for shaping curved panel 222, which does not have the adjacent pairs of shafts connected together but relies on separate motors for each, may also be used to form the curved panel shown in FIG. 13.

The hydraulic drive system used for powering and controlling the operation of the motors M1 and M2 above described and motor M3 used for driving the intermediate wall portion includes a power source, typically a gasoline powered engine E driving a pump P1 for the motors M1 and M2 and a pump P2 for motor M3. The output of pump P1 is connected by hydraulic line 302 to a control valve 303 having a control lever 304. A tank 301 supplies fluid to pumps P1 and P2. Control valve 303 may be further characterized as a three-position, free flow center, spring-biased hydraulic valve.

A hydraulic line 306 is connected from output port A of the center core to one side of the motors M1 and M2. A hydraulic line 307 is connected from output port B of the center core via a flow divider 308 to the other side of motors M1 and M2. Ports A and B are connected internally of the center core by line 309.

The input side of the center core has its input port P connected by hydraulic line 302 through a check valve 311 to pump P1. The input port T of the center core is connected to tank 312 by a hydraulic line 313. The input port T of the center core is connected internally to ports A and B by a line 314 so that there may be a flow of fluid from the motors M1 and M2 to the tank 312 when the control lever 304 is in the center or neutral position.

When the control lever 304 is pushed away from the operator the valving arrangement shown to the right side in valve 303 is positioned in the center so that there is a P-B and an A-T connection in the valve and fluid is pumped from pump P1 via line 302 through the divider 308, through motors M1 and M2, and back to the tank by a return line 313.

When control lever 304 is pulled toward the operator, the valving arrangement shown on the left side is positioned in the center. Under these conditions there is a P-A connection and a B-T connection in the valve and the flow of the fluid through the motors M1 and M2 is reversed. Motors M1 and M2 run at the same speed in both directions due to the equal division of the fluid by the flow divider 308. The valve 303 is biased by spring 316 to return to the neutral position with the valving arrangement shown in the center when a manual force is removed from control lever 304 and motors M1 and M2 rotate freely or idle.

The output of pump P2 is connected by a hydraulic line 322 to a control valve 323 having a control lever 324. More specifically, the output of pump P2 is connected by line 323 through a check valve 325 to the input port P of the center core of control valve 323. A hydraulic line 326 connects from the output of pump P2 directly to the tank 312 when the lever 324 is in the center position to operate in the same manner as the previously described hydraulic valve 173. Control valve 323 may be further characterized as a three-position, free flow center, detented spool, hydraulic valve.

A hydraulic line 328 is coupled between output port A of the center core and one side of the motor M3. A hydraulic line 329 is connected between output port B of the center core and the other side of motor M3. The ports A and B of the center core are shown to be connected internally of the valve by line 331. Port T of the center core is shown connected internally to output ports A and B by a line 332. A return line 333 connects from port T of the center core to tank 312.

Valve 323 has a detent 335 to hold the control lever 324 in the position in which it has been set to cause the motor M3 to rotate until a release force is applied to the control lever 324.

When the control lever 324 is pushed away from the operator, the valving arrangement to the right side is positioned in the center so that there is a P-B connection and an A-T connection in the valve and fluid is pumped from pump P2 via line 322, valve 325, and line 329 into motor M3 to rotate the motor in one direction.

When the control lever 324 is moved toward the operator the valving arrangement shown on the left side is positioned in the center. With this setting there is a P-A connection and a B-T connection in the valve, and the direction of fluid flow in motor M3 is reversed. The fluid flow lines are connected via the center core to maintain idle fluid flow when the associated motor is not being driven.

In a full sequence of operation, with a straight panel supported by the guide assembly, when control lever 304 is pushed away from the operator the pairs of sidewall dies are powered and push the panel between dies 281, 282, 283 and 284. The control lever 304 is then pulled to the neutral position, control lever 324 is pushed to the drive position, and dies 121 and 122 are powered and grip the panel, while dies 281, 282, 283 and 284 are in the free running mode of operation.

Although the present invention has been described with a certain degree of particularity, it is understood that the present disclosure has been made by way of example and that changes in details of structure may be made without departing from the spirit thereof.

What is claimed is:

1. In a panel forming apparatus for producing a curved panel from a straight panel having upwardly inclined sidewall portions extending from an intermediate wall portion, the combination comprising:

first and second pairs of wall-indenting dies spaced from one another and free to rotate independently of one another to receive therebetween each inclined sidewall portion of a straight panel, said pairs of wall-indenting dies being mounted for free rotation about an axis in an idle mode of operation;

a first hydraulic motor coupled by a power train to simultaneously rotate said first pair of wall-indenting dies at the same speed in a power mode of operation;

a second hydraulic motor coupled by a second power train to simultaneously rotate said second pair of wall-indenting dies at the same speed in a power mode of operation;

a third pair of wall-indenting dies located downstream of, free to rotate independently of, and in line with said first and second pairs of wall-indenting dies arranged to receive the intermediate wall portion of the panel between each of said third pairs and engage said intermediate wall portion of the panel after it has passed through said first and second pairs of wall-indenting dies, said third pair of wall-indenting dies being mounted for free rotation about an axis in an idle mode of operation;

a third hydraulic motor coupled by a third power train to simultaneously rotate said third pair of wall-indenting dies at the same speed;

fluid supply means for delivering fluid under pressure to said motors; and control means for said fluid including a first control valve for controlling the fluid to said first and second hydraulic motors and a second control valve for controlling the fluid to said third hydraulic motor, each of said control valves having an idle setting and a power setting whereby, in operation, during start-up said first and second pairs of wall-indenting dies are powered and said third pair is idling and, after said panel is passed between said third pair of work-indenting dies, said third pair is powered to form said indentations when said panel is passed continuously through said pairs of indenting dies.

2. In a panel forming apparatus as set forth in claim 1 wherein said fluid supply means includes a tank containing the fluid, a first pump for pumping fluid from the tank to said first and second hydraulic motors, and a second pump for pumping fluid from the tank to said third hydraulic motor.

3. In a panel forming apparatus as set forth in claim 1 wherein said first control valve is a three-position, free flow center, spring-biased, hydraulic valve.

4. In a panel forming apparatus as set forth in claim 1 wherein said second control valve is a three-position, free flow center, detented spool, hydraulic valve.

5. In a panel forming apparatus as set forth in claim 1 including a flow divider in a hydraulic line to said first and second motors to drive said motors at the same speed.

6. In a panel forming apparatus as set forth in claim 1 wherein said first and second pairs of dies are arranged at right angles to one another and have an external taper of about one degree.

* * * * *